US006511630B1

(12) United States Patent
Cartier et al.

(10) Patent No.: US 6,511,630 B1
(45) Date of Patent: Jan. 28, 2003

(54) METHOD FOR FORMING A COATING BY USE OF FOAM TECHNIQUE

(75) Inventors: Thomas Joseph Cartier, Scotia, NY (US); D. Sangeeta, Cincinnati, OH (US); Dong-Sil Park, Niskayuna, NY (US); Theodore Robert Grossman, Hamilton, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/411,210

(22) Filed: Oct. 4, 1999

(51) Int. Cl.[7] ..... B22F 7/04

(52) U.S. Cl. ..... 419/9; 419/29; 427/181; 427/189; 427/191; 427/376.7; 427/376.8

(58) Field of Search ..... 427/142, 181, 427/191, 192, 229, 239, 373, 375, 376.3, 376.4, 376.5, 376.6, 376.7, 376.8, 383.7, 419.1, 402, 226, 189; 419/9, 29; 428/553

(56) References Cited

U.S. PATENT DOCUMENTS

| | | | | |
|---|---|---|---|---|
| 4,009,146 A | | 2/1977 | Cork et al. | |
| 4,263,344 A | * | 4/1981 | Radvan et al. | 427/150 |
| 4,347,267 A | * | 8/1982 | Baldi | 427/237 |
| 4,847,116 A | * | 7/1989 | Duit | 427/195 |
| 5,102,701 A | * | 4/1992 | Davos et al. | 427/393.3 |
| 5,332,621 A | * | 7/1994 | Schmidt et al. | 428/318.4 |
| 5,366,765 A | * | 11/1994 | Milaniak et al. | 427/229 |
| 5,424,134 A | | 6/1995 | Dudel | |
| 5,582,784 A | * | 12/1996 | Daws | 264/44 |
| 5,618,591 A | * | 4/1997 | Bernstein, Jr. | 427/544 |
| 5,824,366 A | * | 10/1998 | Bose et al. | 427/239 |
| 5,842,342 A | * | 12/1998 | Stasser et al. | 60/282 |
| 5,849,416 A | | 12/1998 | Coffinberry et al. | |
| 5,989,467 A | * | 11/1999 | Daws et al. | 264/43 |
| 5,989,473 A | * | 11/1999 | Haverty | 264/279 |
| 5,989,692 A | * | 11/1999 | Brown | 428/215 |
| 6,010,565 A | * | 1/2000 | Bastian et al. | 106/122 |

FOREIGN PATENT DOCUMENTS

| | | |
|---|---|---|
| DE | 3620624 | 12/1987 |
| EP | 810297 A1 | 12/1997 |
| GB | 1012478 | 12/1965 |
| GB | 1033560 | 6/1966 |
| GB | 1499820 | 2/1978 |

OTHER PUBLICATIONS

Hawley's Condensed Chemical Dictionary, 12th Ed., p. 534.*
European Search Report.

* cited by examiner

*Primary Examiner*—Daniel J. Jenkins
(74) *Attorney, Agent, or Firm*—Noreen C. Johnson; Christian G. Cabou

(57) ABSTRACT

A method for coating a surface of a substrate, includes providing a substrate having a surface, and coating the surface with a foam suspension containing a powder suspended in a foam to form a coating on the surface. The substrate is then heat treated to densify the coating along the surface.

38 Claims, 1 Drawing Sheet

METHOD FOR FORMING A COATING BY USE OF FOAM TECHNIQUE

BACKGROUND OF THE INVENTION

The invention relates generally to metallurgical processes. More specifically, it is directed to coating processes for substrates such as turbine engine components.

A variety of specially-formulated coatings is often used to protect metal parts that are exposed to high temperatures, e.g., metal parts made from superalloys. For example, aluminide coatings are often used to improve the oxidation- and corrosion-resistance of superalloy materials. In aluminide coatings, the aluminum forms an aluminum oxide (alumina) film on its surface, which functions as a barrier to further oxidation. Such coatings may also serve as a bond coat between the superalloy substrate and a thermal barrier coating (TBC).

Several processes for depositing aluminide layers are available for both newly formed components and components under repair. Such processes include vapor phase deposition techniques and what is known in the art as the 'pack cementation process.' While vapor phase techniques are suitable for coating internal and external surfaces of a component, additional processing compexity may be an issue for certain applications. While the pack cementation process is effective at coating internal surfaces of a component, this process is expensive, time consuming, and requires highly specialized equipment, generally requiring the component to be shipped from the job site to an outside service provider in the case of components under repair.

Accordingly, a need exists in the art for further improved and alternative methods for forming aluminide coatings.

SUMMARY OF THE INVENTION

According to one aspect of the invention, a method for coating a surface of a substrate includes providing a substrate having a surface, and coating the surface with a foam suspension containing a powder suspended in a foam to form a coating on the surface. The substrate is then heat treated to densify the coating along the surface.

BRIEF DESCRIPTION OF THE DRAWINGS

The FIGURE is a cross-sectional illustration of the serpentine cavity used for coating with a foam suspension.

DETAILED DESCRIPTION OF THE INVENTION

Figure 1:
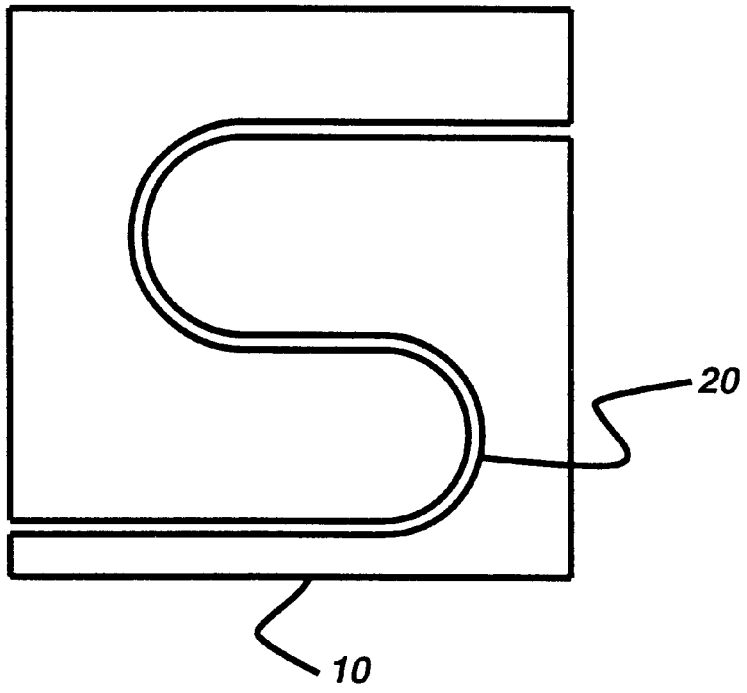

Embodiments of the present invention are drawn to methods for coating a substrate, particularly methods for forming a coating on an internal surface of a substrate. The substrate is typically formed of an alloy, and is in the form of a turbine engine component. Exemplary substrates are formed of superalloy materials, known for high temperature performance in terms of tensile strength, creep resistance, oxidation resistance, and corrosion resistance, for example. The superalloy component is typically formed of a nickel-base or a cobalt-base alloy, wherein nickel or cobalt is the single greatest element in the superalloy by weight.

Illustrative nickel-base superalloys include at least about 40 wt % Ni, and at least one component from the group consisting of cobalt, chromium, aluminum, tungsten, molybdenum, titanium, and iron. Examples of nickel-base superalloys are designated by the trade names Inconel®, Nimonic®, Rene® (e.g., Rene®80-, Rene®95, Rene®142, and Rene®N5 alloys), and Udimet®, and include directionally solidified and single crystal superalloys. Illustrative cobalt-base superalloys include at least about 30 wt % Co, and at least one component from the group consisting of nickel, chromium, aluminum, tungsten, molybdenum, titanium, and iron. Examples of cobalt-base superalloys are designated by the trade names Haynes®, Nozzaloy®, Stellite® and Ultimet®.

The term "aluminide" or "aluminide-containing" as used herein is meant to include a variety of aluminum-containing materials that are typically used in coating metal alloys (especially superalloys), or which are formed during or after the coating process. Non-limiting examples include aluminum, platinum aluminide, nickel aluminide, platinum-nickel aluminide, refractory-doped aluminides, or alloys which contain one or more of those compounds.

While development of embodiments of the present invention have been directed towards coating of internal surfaces, both internal and external surfaces can be coated according to the techniques described herein. The term "internal surface" of the substrate denotes a surface or surface portion that is not generally exposed to an exterior of the substrate, and is difficult to access or manipulate from an exterior of the substrate. While internal surfaces include cavities and passageways, typically internal surfaces that are treated according to embodiments of the present invention are passageways, elongated openings each having an inlet and an outlet. The terms "inlet" and "outlet" denote first and second opposite openings of the passageway. The terms are relative in that they may be assigned to the opposite openings arbitrarily depending on the particular perspective and any intended gas flow through the passageway during actual use of the component incorporating the substrate. The substrate may have a plurality of internal passageways, such as in the case of an airfoil, including buckets, blades, and nozzles, of a turbine engine.

The passageway typically has a high aspect ratio, generally not less than 5, and typically not less than about 10. According to particular embodiments of the present invention, the aspect ratio is not less than about 20, such as not less than about 40. The aspect ratio is defined as the ratio of the length of the passageway divided by the minimum cross-sectional dimension of the passageway. The passageway may be straight or have a curved contour, including complex curved contours, such as serpentine passageways. In such a case, the length of the passageway is defined by the actual path length of the passageway, not the straight-line distance between the ends (i.e., the inlet and the outlet).

The term "minimum cross-sectional dimension" denotes the smallest dimension of the passageway in cross-section. In the case of an annular passageway, the minimum cross-sectional dimension is the diameter of the passageway taken at a cross section having the smallest cross-sectional area along the entire length of the passageway. According to an embodiment of the present invention, the internal passageway is generally annular, that is, circular in cross-section, and has a minimum diameter within a range of about 10 mils to about 400 mils. Further, typical internal passageways have a length within a range of about 3 inches to about 30 inches, such as about 6 inches to about 20 inches.

According to an embodiment of the present invention, a method for forming a coating on the internal passageway of a substrate calls for coating a foam suspension along the internal passageway. The foam suspension contains a powder suspended in a foam carrier. As used herein, the terms "foam carrier" and "foam" mean a liquid that forms an aggregation of bubbles. The bubbles contain a gas, such as ambient air or carbon dioxide. The foam may be formed by agitating or whipping a liquid, such as an organic resin, to froth the liquid into a foam having low density; the actual volume of the foam may be on the order of 1.5 to 10 times the volume of the base liquid before frothing. Alternatively, the foam can be a commercially available product held under pressure until use, such as commonly available polyurethane foam sealant. The composition of the foam carrier is chosen to ensure substantially complete burn-out (volatilization) during a subsequent heat treatment step. The foam carrier should also be physically stable, that is, hold the original gas volume during the elapsed working time, or more preferably, increase in volume following application onto the internal surface of the substrate (i.e., self-expanding in ambient air). Such stability ensures that uniform distribution of the powder on the substrate during the coating process. Polyurethane foams meet these criteria, and increase in volume by trapping carbon dioxide gases within the polyurethane liquid.

In one embodiment, a suspension of a foam precursor is injected or otherwise coated on the internal passageway, followed by expansion of the precursor into a foam to conformally coat the surface.

Typically, the precursor self-expands, such as by reaction of the precursor to form trapped gas bubbles. For example, in one embodiment, the precursor reacts with water vapor. The powder is typically metallic, although in certain applications, a non-metallic powder such as a ceramic might be used. According to a particular embodiment of the invention, the metallic powder is aluminum-based used for forming aluminide coatings on turbine engine components. The aluminum powder typically has an average particle size $d_{50}$ within a range of about 1 to about 75 microns, such as about 1 to 20 microns. In one particular example, the powder has an average particle size of about 7 microns. The foam suspension can be loaded with a varying proportion of aluminum powder, depending upon the desired rheological properties of the foam suspension, coating thickness, etc. In one embodiment, the aluminum powder is in a slurry suspension prior to mixing with the foam to prevent unwanted agglomeration when mixed with the foam carrier. According to one embodiment, the slurry contains about 30.0 to about 45.0 wt. % aluminum powder in an aqueous solution. The slurry may further contain additional powders such as silicon, within a range of about 2.0 to about 8.0 wt. %. In one particular form, the aqueous solution contains a chromate and a phosphate. More particularly, the slurry contains about 1.0 to about 6.0 wt. % chromate, and about 15.0 to about 25.0 wt. % phosphate. In an alternative embodiment, the slurry is non-aqueous, containing an organic liquid medium in which the metallic powder is suspended rather than an aqueous-based liquid medium. Examples of organic liquid mediums include toluene, acetone, various xylenes, alkanes, alkenes, and their derivatives. More typically, the aluminum powder is mixed directly with the foam. The aluminum powder is generally loaded in the foam within a range of about 1 to 20 parts by weight with respect to 10 parts by weight of the foam.

The foam may be coated on the internal surface or surfaces by various techniques. Manual techniques, such as using a syringe-type caulking gun, can be used to dispense the foam suspension under pressure to fill the internal passageway. Typically, the foam carrier is mixed with the metal powder to form the foam suspension, and the suspension is then loaded into a dispensing means. Alternatively, the foam carrier and the metal powder may be pre-mixed and held in a pressurized vessel. In this case upon opening a valve to the ambient air, the foam is then allowed to expand and flow, carrying the metal powder suspended therein. Coating effectiveness may be further enhanced by utilizing a foam carrier that increases in volume (more gas volume) as a function of temperature and/or time. After dispensing, a gas flow through the passageway, such as from a compressed gas source, is typically carried out to drive the foam into the passageway. In other cases, the pressure from release of the foam suspension, coupled with self-expanding properties of the foam suspension, is sufficient to form a conformal coating in the passageway.

The particular details of the technique for coating a passageway are chosen based on several parameters, including the minimum and maximum cross-sectional areas of the passageway, length of the passageway, the desired thickness of the metal-based coating, surface tension, viscosity, and other rheological properties of the foam suspension.

Following coating, the foam suspension is dried or cured to drive evaporation of the liquid medium of the suspension and form a metal-containing coating. Drying can be done at room temperature, although an elevated temperature can be employed to reduce drying time to the order of several minutes. In the case of an organic resin foam carrier such as polyurethane, the foam suspension is cured prior to further processing. Drying or curing can be carried out as part of a sintering or baking procedure, employing either a slow initial ramp-up of temperature or a temperature hold to accommodate drying.

The thickness of the coating may be adjusted or modified by suitably adjusting the concentration of aluminum powder within the foam carrier, such as within about 1 to about 20 parts by weight with respect to 10 parts by weight of the foam. Alternatively, several foam injections may be carried out to increase the thickness of the deposited material. Generally, the injected foam is permitted to outgas between injections, to accommodate the next injection of foam. In one embodiment, following each injection, outgassing of the foam is permitted, followed by heat treatment. By such a process, each application of the series of steps (injection, outgassing, and heat treatment) is effective to increase the coating thickness by the approximate value of the original coating. For example, three series of steps provides a coating of approximately 3 times (3×) the initial thickness. Repetition of the steps is advantageous for certain applications, such as in the case of forming an aluminide coating for a turbine engine component. In this case, typically the average thickness is not less than about 0.5 mils, such as about 0.5 mils to about 10 mils.

Following drying or curing, the substrate is subjected to a heat treatment to sinter or bake the coating, thereby densifying the coating. Preferably, the heat treatment step forms a conformal coating, which is adhered to or coats substantially the entirety of the surface to which it is applied, without blocking the internal surface and having substantial variations in thickness. For example, in one embodiment, a conformal coating has a thickness that varies within a range such as about 0.4 mils to about 5.0 mils. This conformal coating is typically metal-based, wherein a metal component is the single greatest component in the coating by weight, or sum of several metallic components form the largest weight percentage in the coating. Metallic components include metallic elements and alloys. An aluminum-base coating is preferable for forming a diffusion coating on turbine engine components.

In the case of a resin foam carrier, the resin is burned-off or volatilized. The heat treatment temperature is largely dependent on the particular material of the coating, as well as the intended environment of the treated substrate. In the case of an organic resin such as polyurethane, a temperature on the order of about 300 to about 600° C. may be used.

As a part of the heat treatment to bake the coating, or following the heat treatment step, the coating may be subjected to a diffusion treatment to form a diffusion coating, more specifically a "high-temperature" aluminide diffusion coating. Typical diffusion temperatures are generally not less than 1600° F. (870° C.), such as within a range of about 1800° F. (982° C.) to about 2100° F. (1149° C.). Such diffusion coatings provide high temperature oxidation and corrosion resistance to turbine components. The elevated temperature causes the aluminum to melt and diffuse into the underlying substrate to form various intermetallics. In the case of a nickel-base superalloy substrate, the aluminum diffuses and bonds with the nickel to form nickel-aluminide coatings. In some embodiments, a precious metal such as platinum is first deposited over the substrate prior to application of the aluminum-based slurry as described herein. In this case, the aluminum is diffused to form platinum aluminide intermetallics, as well as nickel aluminide intermetallics and platinum nickel aluminide intermetallics.

The following examples are illustrative, and should not be construed to be any sort of limitation on the scope of the claimed invention. Use of tubes and fixtures in the following examples model internal passageways typically found in a substrate such as a turbine engine component, including airfoils.

EXAMPLE 1

An aluminum-based slurry was mixed with polyurethane foam by hand in a 10:10 weight ratio to form a foam suspension. The aluminum slurry is available under the designation Alseal® 625 from CFI, Inc. The polyurethane foam is commercially available material as Great Stuff®, generally used for household insulation and was dispensed from an aerosol can. The slurry had a nominal composition of 37.7 wt % Al, 4.2 wt % Si, 58.1 wt % of a chromate/phosphate solution. The foam suspension was then injected into an aluminum fixture 10 containing a serpentine cavity 20 having a nominal diameter of 125 mils and length of 6 inches as shown in the Figure. The foam suspension was also injected into a stainless steel tube having a nominal diameter of 105 mils, and a length of 6 inches. The serpentine cavity and the tube were used to model coating behavior in a turbine engine component, such as in the passageways of an airfoil. Injection was carried out by loading a caulking gun with the suspension and squeezing the trigger of the gun to eject the foam suspension into the cavity. Observations of free-standing samples of the foam suspension after mixing showed 50 volume % expansion in 4 to 6 hours at room temperature.

The samples were then left undisturbed at room temperature for 1 hour to cure the polyurethane foam, and then heat treated at 500° C., thereby volatilizing and burning-off the polyurethane. The resultant coating had a nominal thickness of about 1 to 1.5 mils. Processing with coating of an actual turbine engine component would continue with steps such as high temperature aluminum diffusion treatment.

EXAMPLE 2

Several aluminum foam suspensions were hand mixed at 10:10, 15:10, and 20:10 weight ratios of aluminum powder (15 micron average particle size):polyurethane foam. The 10:10 suspension was observed to expand 100 volume % of its initial, as-mixed volume at room temperature in 2 hours. The 15:10 suspension expanded 30 to 35 volume % at room temperature in 2 hours. The 20:10 mixture did not exhibit any appreciable expansion.

The 15:10 foam suspension was injected into a stainless steel and Inconel tubes by air injection at 30 psi. The foam was cured at room temperature for 1 hour. Each type of tube was then baked at 300° C., 400° C., and 500° C. During each heat treatment, the foam carrier expanded out of the tube and volatilized, leaving behind an aluminum-based coating having a nominal thickness of 1 to 1.5 mils.

EXAMPLE 3

The 15:10 foam suspension of Example 2 was injected into the serpentine cavity of Example 1. The mixture exhibited conformal expansion along the entirety of the serpentine surface in 2 hours.

The following examples are similar to Examples 1 through 3 above, but incorporate the use of an activator in the coating. The activator contains a species that complexes with the metallic element, generally aluminum, of the foam suspension, and functions to improve coating uniformity. It is believed that the complex containing the metallic element vaporizes during high temperature diffusion treatment and deposits along coating regions having a relatively low concentration of the metallic element. The activator generally includes a halide, such as flourine, chlorine, iodine, bromine, which complexes with the metallic element. Particular examples of activators include $AlF_3$, $AlCl_3$, $NH_4F$, $NH_4I$, $NH_4Cl$, $NH_4Br$, and $NH_4F.HF$. These activators form a $AlX_3$ complex, where X is the halide element. The activator may also provide a cleansing effect along of the surface being treated. The activator is generally added at a stage prior to high temperature diffusion treatment, such as with the foam suspension or following a bakeout step of the foam carrier.

EXAMPLE 4

A Rene N5 tube, 0.300" ID×0.050" wall, was cut to a length of about 2", and was degreased in isopropyl alcohol ultrasonically for 5 minutes, and then air dried. This piece was then preheated on a hot plate to a temperature of about 100 C. 15 g of aluminum powder of −400 mesh particle size was mixed with 10 g of polyurethane-based foam of Example 1. This mixture was injected into the inside of the tubing at 40 psi using a syringe and tip. After being cured for 30 min., during which the Al powder/foam mix expands and fills the tube, the piece was baked out at 550 C for 2 hours in air, yielding a coating of aluminum onto the internal surface of the tube. A chemical activator was then introduced into the tube. A solution of 75 g of $NH_4Cl$ was dissolved in 250 cc of distilled H2O at 50 C, and injected into the tube. Excess solution was drained, and the tube was dried at 120° C. leaving a skin of $NH_4Cl$ on the internal surface of the tube. This piece was then heat treated at 2,050 F for 2 hours in argon to make a diffusion coating. During the heat treatment, the ends of the tube were covered with graphite foil to minimize loss of the activator. Micrographic analysis showed that the activator contributed to improvement in the uniformity of the coating thickness.

EXAMPLE 5

Another Rene N5 tube was degreased, air dried and preheated as before and was injected with aluminum powder and foam mixture containing an activator in the following manner. 15 g of aluminum powder of −400 mesh size was mixed with 10 g of foam as in Example 4. Into this mix, 1.5 g of $AlF_3$ powder was added to serve as chemical activator. This mix was injected into the tube, cured and baked out at 550 C for 2 hours in air. This piece was then heat treated at 2,050 F for 2 hours in argon to make a diffusion coating. The ends of the tube were covered with graphite foil during the heat treatment to help contain AlF3 inside the tube. Micrographic analysis showed that the activator contributed to improvement in the uniformity of the coating thickness.

EXAMPLE 6

A turbine blade was degreased in isopropyl alcohol for 5 minutes, air dried, and then was preheated to about 100 C on a hot plate, aided by a heat lamp. 15 g of aluminum powder of −400 mesh size was thoroughly mixed with 10 g foam and 1.5 g AlF3 activator. This mixture was then injected into the three internal passages of the blade at 40 psi. To ensure a full coating of all the passages of this blade, which has turbulated serpentine cavities, multiple injections were applied, each lasting for 10 seconds: 2 applications for trailing edge (TE) passages, 2 for center passages and 3 for the leading edge (LE) passages. After a 30-minute cure, the blade was baked in an oven at 550 C for 2 hours. After the external surface was cleaned, the blade was then heat treated at 2,050 F for 2 hours in argon to make a diffusion coating. Micrographic analysis showed that the activator contributed to improvement in the uniformity of the coating thickness

EXAMPLE 7

Another turbine blade was degreased as before and was preheated to about 80 C. A mixture of aluminum powder and foam was prepared by thoroughly mixing 5 g of aluminum powder of −400 mesh size with 10 g of foam. This mix flows and expands more readily than the 15 g Al/10 g foam mix of the previous examples. One application to each of the passages at 30–40 psi allowed a full coverage of the internals as evidenced by this mix coming through all the cooling holes. After a 30-minute cure, the blade was baked at 550° C. for 2 hours, and then $NH_4Cl$ activator was introduced essentially as in Example 4. The blade was dipped in the 30% $NH_4Cl$ solution in $H_2O$ a few times up and down to promote full wetting. After draining excess solution, the blade was dried at 120 C for about 10 minutes. After wiping off excess $NH_4Cl$ around cooling holes, the blade was diffusion heat treated at 2,050 F for 2 hours in argon. FIG. 6 shows a typical micrograph of the coating, which displayed a much more uniform coating thickness and fewer defects than that of the control blade of Example 4.

Other Examples

Aluminum powders of different particle sizes ranging from −325 mesh to 4 um were tried on tubes as well as on blades, and were found to work in a way very similar to −400 mesh powder of Examples 4–7.

Various embodiments of this invention have been described herein. However, this disclosure should not be deemed to be a limitation on the scope of the claimed invention. For example, while the foregoing description describes coating on internal surfaces, external surfaces can be coated using the techniques described herein. In this case, the substrate is generally placed in a mold, such that a gap is present between the external surface of the substrate that is to be coated, and an inner surface of the mold. Injection of the foam or foam precursor and the metallic powder suspended therein proceeds as described herein. The gap between the mold and the substrate provides an avenue for propagation of the foam or foam precursor. Still further modifications, adaptations, and alternatives may occur to one skilled in the art without departing from the scope of the present claims.

What is claimed:

1. A method for coating an internal surface, comprising the steps of:

providing an internal surface of a serpentine passageway of a turbine engine component;

coating the internal surface with a foam suspension containing a metal powder suspended in a foam to form a coating on the internal surface; and heat treating to densify the coating along the internal surface.

2. The method of claim 1, wherein the surface is an internal surface of an airfoil.

3. The method of claim 1, wherein the internal surface comprises a passageway extending through a substrate.

4. The method of claim 3, wherein the step of coating is carried out by flowing a gas into the passageway to drive the foam suspension into the passageway.

5. The method of claim 4, wherein the gas is supplied from a compressed gas source.

6. The method of claim 3, wherein the foam suspension is contained with a compressed gas, and dispensing of the foam suspension from the compressed gas source causes the foam suspension to flow into the internal passageway.

7. The method of claim 3, wherein the substrate comprises a plurality of internal passageways.

8. The method of claim 3, wherein the internal passageway has an aspect ratio of not less than 5, the aspect ratio being a ratio of length of the internal passageway divided by the minimum cross-sectional dimension of the internal passageway.

9. The method of claim 8, wherein the internal passageway is generally circular in cross-section, and the minimum cross-sectional dimension is the minimum diameter.

10. The method of claim 9, wherein the aspect ratio is not less than about 10.

11. The method of claim 3, wherein the internal passageway is generally circular in cross-section and has a minimum diameter of about 10 mils to about 400 mils.

12. The method of claim 1, wherein the coating has an average thickness not less than about 0.5 mils following heat treatment.

13. The method of claim 1, wherein the surface is an external surface.

14. The method of claim 1, wherein the surface is coated with a foam precursor having the powder suspended therein, wherein the foam precursor expands to form said foam.

15. A method for coating an internal surface, comprising the steps of:

providing an internal surface of a passageway of a substrate, wherein the substrate comprises an alloy;

coating the surface with a foam suspension containing a powder and an activator species suspended in a polyurethane foam to form a coating on the surface; and heat treating the substrate to densify the coating along the surface.

16. The method of claim 15, wherein the substrate comprises a turbine engine component.

17. The method of claim 16, wherein the turbine engine component is an airfoil, and the inner surface is a plurality of internal passageways.

18. The method of claim 16, wherein the turbine engine component comprises a superalloy.

19. The method of claim 18, wherein the superalloy comprises a nickel-base or a cobalt-base superalloy, wherein nickel or cobalt is the single greatest element in the superalloy by weight.

20. The method of claim 19, wherein the superalloy is nickel-based.

21. The method of claim 1, wherein said metal powder comprises aluminum powder.

22. The method of claim 21, wherein the foam suspension contains about 1 to about 20 parts by weight of said aluminum powder with respect to 10 parts by weight of said foam.

23. The method of claim 21, wherein the aluminum powder has an average particle size within a range of about 1.0 microns to about 15 microns.

24. A method for coating an internal surface, comprising the steps of:

providing an internal surface of a passageway;

preparing a suspension of foam precursor containing an aluminde powder coating the internal surface with the foam precursor and;

expanding the precursor into a foam to conformally coat the internal surface; and heat treating to densify and form a coating along the internal surface.

25. The method of claim 24, wherein the organic resin comprises polyurethane.

26. A method for coating an internal surface, comprising the steps of:

preparing a foam suspension containing a powder providing an internal surface of a passageway of a turbine engine component;

coating the internal surface with a foam suspension containing a powder to form a coating on the internal surface; and permitting the foam suspension to outgas after coating and then coating the internal surface with additional foam suspension.

27. The method of claim 26, wherein said temperature is within a range on the order of about 300 to about 600° C.

28. The method of claim 1, wherein the metallic powder comprises aluminum, and the method further comprises a step of subjecting the substrate to a high-temperature diffusion treatment.

29. A method for coating internal passageways of a turbine engine component, comprising the steps of:

providing a turbine engine component having internal passageways;

coating the internal passageways with a foam suspension containing a aluminum powder suspended in a foam;

heat treating the foam suspension at a temperature to volatilize the foam to form an aluminum-base coating along the internal passageways; and subjecting the substrate to a diffusion treatment to diffuse aluminum into the substrate.

30. The method of claim 29, wherein the internal passageways have an aspect ratio of not less than 5, the aspect ratio being a ratio of length of a respective internal passageway divided by the minimum cross-sectional dimension of the respective internal passageway.

31. The method of claim 30, wherein the internal passageways are generally circular in cross-section, and the minimum cross-sectional dimension is a minimum diameter.

32. The method of claim 30, wherein the aspect ratio is not less than about 10.

33. The method of claim 30, wherein the aspect ratio is not less than about 20.

34. The method of claim 30, wherein the aspect ratio is not less than about 40.

35. The method of claim 29, wherein the turbine engine component is an airfoil.

36. The method of claim 35, wherein the diffusion treatment is carried out at a temperature of not less than 870+ C.

37. The method of claim 29, wherein the foam comprises an organic resin.

38. The method of claim 37, wherein the organic resin is self-expanding.

* * * * *